United States Patent [19]

George et al.

[11] Patent Number: 4,565,504

[45] Date of Patent: Jan. 21, 1986

[54] PNEUMATIC METERING PUMP APPARATUS

[76] Inventors: Albert A. George, P.O. Box 3604, Lafayette, La. 70502; David B. George, 304 Upland Dr., Layfayette, La. 70506

[21] Appl. No.: 543,531

[22] Filed: Oct. 20, 1983

[51] Int. Cl.[4] ..... F04B 9/12

[52] U.S. Cl. ..... 417/401; 91/318; 91/469

[58] Field of Search ..... 417/401, 392; 91/318, 91/469

[56] References Cited

U.S. PATENT DOCUMENTS

| | | | |
|---|---|---|---|
| 3,387,563 | 6/1968 | Williams et al. | 91/318 X |
| 3,492,946 | 2/1970 | Martin | 417/401 |
| 3,561,324 | 2/1971 | Obergfell | 91/318 X |
| 4,102,609 | 7/1978 | Wood | 91/318 X |

FOREIGN PATENT DOCUMENTS

| | | | |
|---|---|---|---|
| 2648412 | 4/1978 | Fed. Rep. of Germany | 91/318 |

*Primary Examiner*—Leonard E. Smith

*Attorney, Agent, or Firm*—Pravel, Gambrell, Hewitt & Kimball

[57] ABSTRACT

A pneumatic metering pump apparatus, having a pump member, working in combination with power head means wherein a pneumatically driven piston would cooperate with the pump means. There would be further provided a fluid inlet providing fluid flow to the power head and a valving element in communication with the first fluid inlet and the piston. Further, a timer would be in fluid communication with the valve and piston, would also include a valving element housed in the valving member for providing fluid communication between the valving member and the piston when the valving member is in the first position and blocking fluid communication between the valving member and the piston and establish fluid communication between the piston and an exhaust when the valving member is in a second position.

8 Claims, 10 Drawing Figures

PNEUMATIC METERING PUMP APPARATUS

BACKGROUND OF THE INVENTION

1. Field of the Invention

The apparatus of the present invention relates to pneumatically driven metering pumps. More particularly, the apparatus of the present invention relates to a pneumatically driven metering pump having a power head and pumping head cooperating to deliver metered amounts of flowable fluids under pressure to a process or system over a given range of volume per unit time.

2. General Background

In industry, there is a need for a pump mechanism which has the ability to introduce relatively small quantities of a chemical or fluid into a flow line, for example, ordorants into a gas line or bacteriorants, such as chlorine or the like, into a water line. In the present state of the art, this is being accomplished by a pump which is driven pneumatically and when used in conjunction with either a type of metering device and valve, in the system, is able to accomplish an end result of providing a metered amount of chemical over a given unit of time. However, such a system is as used in the art, provides that the valve and metering unit in the system are separate from the pump itself, and therefore requires that an extensive system of flow lines be established for communication between the metering unit, the valving unit and the pump itself. This, of course, is an expensive system and requires additional space for the system. When used, for example, on an oil or gas platform, the expense and utilization of valuable space creates enormous problems on the rig, together with the constant monitoring and maintenance of the system.

The apparatus of the present invention would provide a pneumatically driven metering pump which has intergral to it the valving member and timing mechanism which would enable it to function over an extended period of time without maintenance, without the extensive exterior flow lines and in a much more restricted space.

SUMMARY OF THE PRESENT INVENTION

The apparatus of the present invention would provide a pneumatically driven metering pump having a pumping head for delivering metered amounts of flowable fluids under pressure to a process or system over a given range of volume per unit time. The apparatus would further comprise a power head assembly in cooperation with the pumping head, the power head assembly providing a valving means and a timing means secured to the power head assembly, with the valving means and timing means in fluid communication with a piston member movable in the power head assembly so that upon introduction of pressurized air into an inlet port, the air is channeled to the valving means through a first fluid passageway for further channelling to the piston chamber through a second fluid passageway. The inlet fluid then pressurizes the piston chamber for imparting downward movement to the piston against the bias of a spring. The fluid simultaneously moves by a metering valve for chanelling through a third fluid passageway to a second portion of the valving means, wherein opposite pressure within the valving means effects a seal against the first fluid port for blocking inlet fluid flow and establishing fluid communication between the piston chamber and the exhaust for bleeding the pressurized fluid out of the piston chamber, allowing upward movement of the piston for completion of the pump cycle. Upon loss of equal and opposite forces within the valving means, a fluid tight seal again is effected between the valving element and the bleed port for reestablishing fluid flow between the inlet pressurized air and the piston chamber for resumption of the next cycle of the pump apparatus.

Therefore it is an object of the present invention to provide a pneumatic metering pump apparatus wherein there is provided a power head and a pump head working cooperatively to meter the fluid flow therethrough;

It is a further object of the present invention to provide a pump apparatus with having a metering means and valving means working cooperatively to achieve the metering of fluid flow therethrough;

It is further object of the present invention to provide a pneumatic metering pump apparatus wherein the pneumatic metering function is accomplished through fluid communication between a valving element, power head assembly, metering means through a system of internal fluid passageways within the power head assembly; and It is still a further object of the present invention to provide a compact pneumatic metering pump apparatus which can be used over a broad range of power head assembly sizes and fluid pressures to achieve a broad range of pumping functions.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
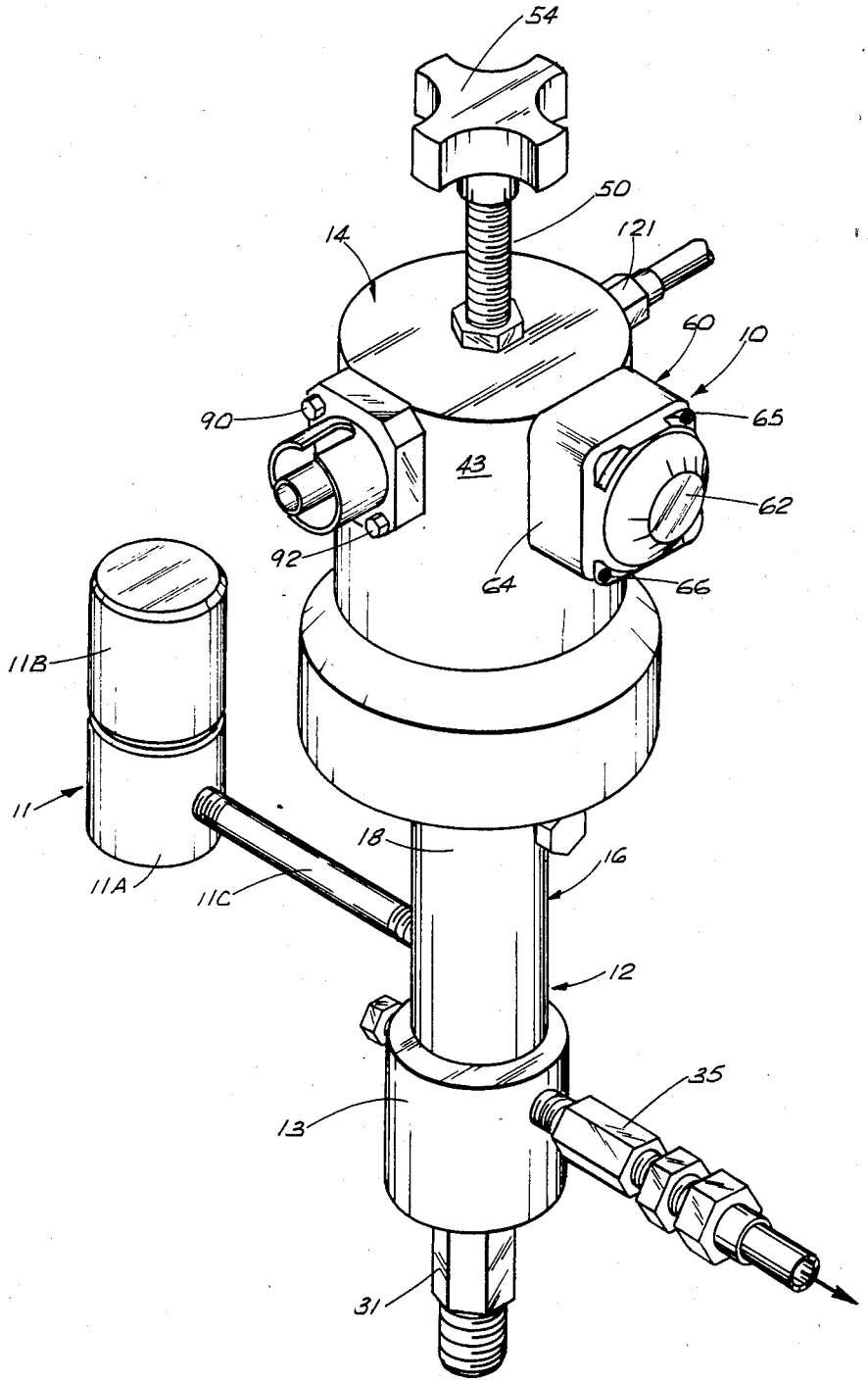
FIG. 1 is an overall perspective view of the preferred embodiment of the apparatus of the present invention.

The overall apparatus of the present invention is represented in FIGS. 1 through 8 by the numeral 10. Apparatus 10 comprises a first pump means 12 and a power head means 14. Pump means 12 and power means 14 would be cooperatively connected to provide for the delivery of metered quantities of fluid under pressure to a volume or system during the operation of the apparatus.

Since, for the most part, pump means 12 is a standard reciprocating pump, it will be described initially. Pump means 12 further comprises a substantially elongated pump body 16, which would comprise a lower pump chamber 13 threadably engaged to a mounting tube 18 with the upper portion of mounting tube 18 threadably engaged to a removable mounting flanged member 19 with flanged member 19 secured to the inside lower wall portion of power head means 12, secured thereto between shoulder portion 15 of head means 12 and spiral ring member 17. Flanged member 19 further defines the lower base portion of power head means 14, the function of which will be described further. Also provided within pump means 12 is spring member 26 which is compressed during downward stroke of piston 25, and imparts upward movement of piston 25 during the pumping cycle.

Pump body 16 further provides internal plunger member 21 reciprocal upward and downward within a pumping chamber 13 on its lower end, and fixedly secured to piston member 25 on its upper end, with piston 25 contained within cylinder 27 in power head means 14, so that upward and downward reciprocating movement of piston 25 likewise imparts upward and downward movement or "pumping action" of plunger 21. Pump means 12 also provides for means to lubricate plunger member 21 with the introduction of lubricating oil to upper chamber 13A via lube means 11. Means 11 comprises a lube body portion 11A for mounting a lubricant containing bottle 11B thereunto lube body portion 11A is threadably mounted to chamber 13A via mounting tube 11C, wherein lubricant is introduced into chamber 13A in measured amounts for providing that plunger 21 be lubricated during the pumping action. There is further provided elasomeric seal member 11D between upper chamber 13A and main pumping chamber 13.

As was stated earlier, the pumping action of pump 12 is standard in that pumping chamber 13 further provides fluid inlet port 29 with suction check valve 31 threadable mounted thereinto for receiving fluid into pump chamber 13. Check valve 31 is a standard suction check valve and therefore will not be discussed. There is further provided port 33 in fluid communication with pump chamber 13, also having threadingly engaged thereto discharge check valve 35 which is also a standard discharge check valve known in the industry, therefore will not be discussed in detail. Pump chamber 13 also has threadably mounted thereinto bleeder valve 37 which is also in fluid communication with fluid chamber 13.

Therefore, in operation of pump means 12, as plunger 21 is reciprocated upward, fluid or chemical is suctioned into pump chamber 13 via suction valve 31, and as plunger is reciprocated into the downward position, the fluid or chemical contained in pump chamber 13 is likewise discharged from discharge check valve 35 into the system wherein the chemical is to be received.

As was stated earlier, this reciprocating movement of plunger 21 is provided through the reciprocating movement of piston 25 contained in power head means 14, the functioning of which in combination with a timing means and valving means comprises the overall novelty of the present invention.

Turning now to FIGS. 2–8, power head means 14 further provides a power head body 40 which is substantially a cup-shaped head having a continuous side wall 42, the upper portion of power head 40 providing a thickened upper portion 43 which defines a means for mounting valving means 44 and timing means 46 onto the exterior of power head 40, the overall function of which will be described further. A lower portion of power head means 40 provides continuous wall portion 42 having a thickened lower shoulder portion 45, for accommodating the securing of mounting flanged member 19, as was described earlier. Lower continuous wall portion 42 defines on its interior cylinder space 27, wherein piston 25 is contained therein for reciprocating upward and downward during the functioning of the apparatus.

As seen in the FIGURES, particularly in FIG. 1, the outermost wall of piston 25 does not sealably engage the innermost wall of cylinder 27, but there is provided U-cup ringed member 47 for providing a fluid tight seal between the inner wall of cylinder 27 and the outermost wall of metal piston 25.

Figure 2:
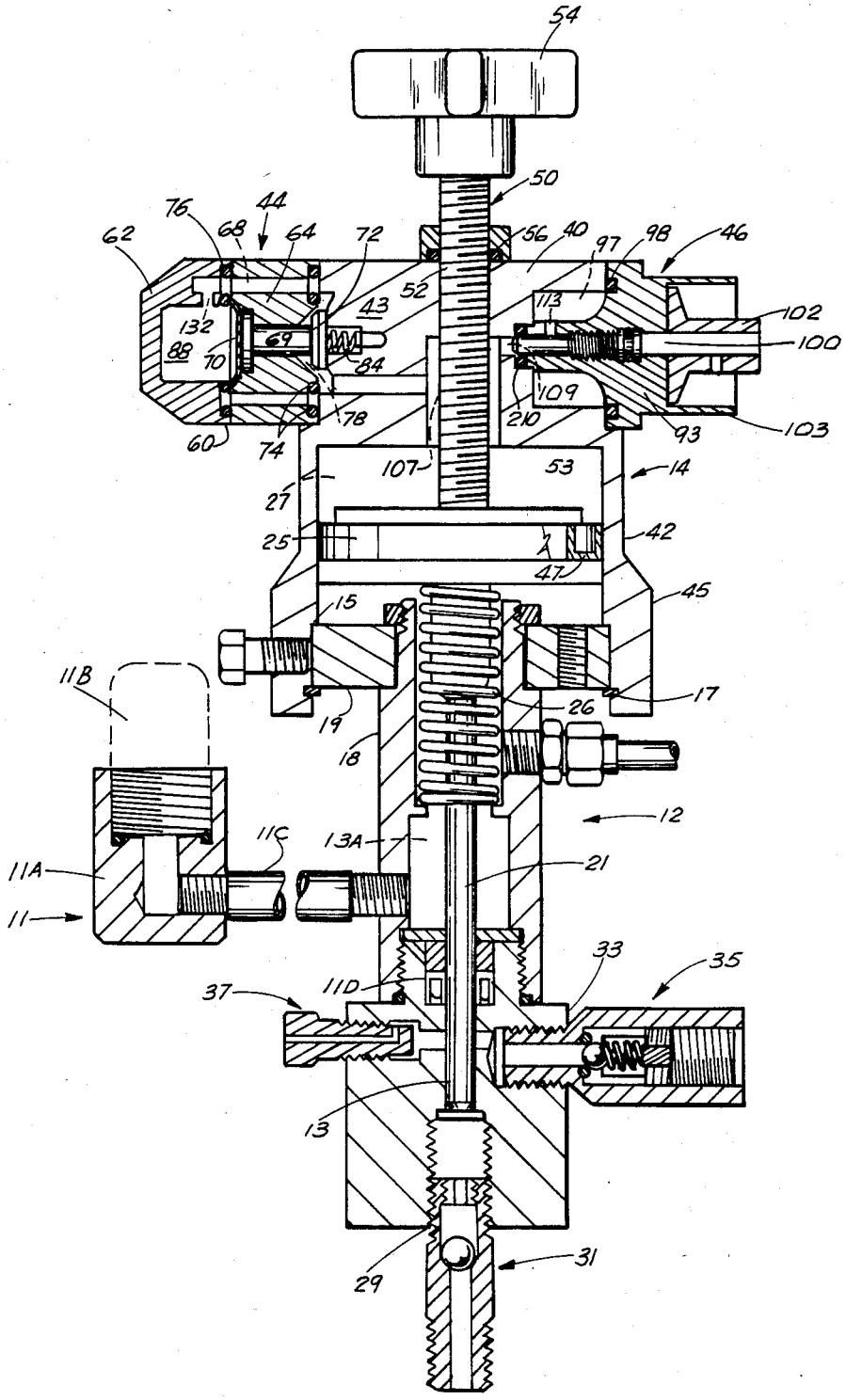
FIG. 2 is a side cross-sectional view of the preferred embodiment of the apparatus of the present invention.

As is seen in FIG. 1, power head 40 further provides stroke adjuster means 50 which comprises substantially a threadably engaged screw member 52 threadably mounted through the top portion of head 40, and the end portion 33 of which extrudes into cylinder space 27, and in the functioning, as piston member moves upward within cylinder space 27, its stroke can be shortened by making contact by the center portion of piston 25 making contact with end 53 stroke adjustor 50. Of course, depending on the length of screw member 52 extruding into chamber 27, would dictate the length of the stroke of piston 25 as it moves upward and downward during operation of the apparatus. As seen in FIG. 2, stroke adjustor screw 52 would enter a counter bore 107 in communication with cylinder 27, the purpose to be discussed further.

In the maintenance of the apparatus, it is important that stroke adjustor 50 be mounted concentrically with the center of piston 25, so that the striking of piston 25 against stroke adjustor 50, would not tend to shift the position of piston 25 within cylinder 27, and create angular displacement. Stroke adjustor 50 is threadably adjusted with exterior handle member 54, and is sealably engaged into head 40 via mounting nut 56.

As was stated earlier, the upper portion of power head means 40 provides a thickened upper body portion 43, for providing both the necessary mounting for valve means 44, timer means 46, and mounting and control passage for stroke adjuster. In addition, body portion 43 provides for the internal channelling between inlet port 120, valving means 44, timing means 46 and cylinder 27 in the overall operation of the apparatus.

As seen in FIG. 2 through 5, a portion of the side exterior face of power means 40 is adapted for receiving valving means 44 thereunto. Valving means 44 provides a valve body 60 which comprises main valve body portion 64 secured to the face of power head 40, and valve dome cover 62 secured to the outer face of main body portions 64, main body portion 64 and dome cover 62 fixedly secured to power head 40 via mounting screw 65 and 66. As seen in the FIGURES, in addition to the pair of ports for housing the mounting screw 65 and 66, main body portion further comprises a third port 68 for the passage of air or other fluid therethrough during the operation of the valve which will be discussed further. Movably mounted within the central area of main body portion 64 is "T" shaped actuator 69, which is movable laterally within body portion 64 during operation of the valve. Actuator 69 is located intermediate flexible diaphragm member 70 which is positioned at the juncture of cap portion 62 and main body portion 64. And on its opposite end actuator 69 makes contact with main valving member 72 which is located intermediate the juncture of main valve body 64 and power head 40.

Figure 8:
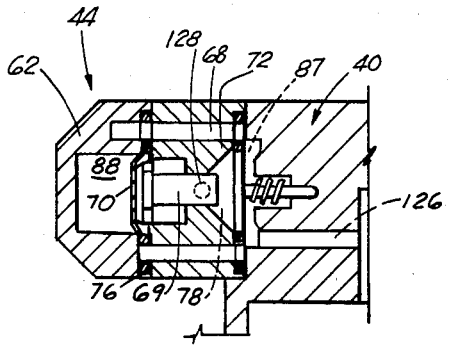
FIG. 8 is a cross-sectional view of the valving means of the apparatus of the present invention.

As further seen in the drawings, there if further provided double O-ring members 74 providing fluid tight seals to the exterior between main valve body 64 and power head 40 and O-ring member 76 for providing fluid tight seal at the juncture of dome cover 62 and main valve portion 64. As further seen in FIG. 2, main valving member 72 is a substantially wafer-shaped valving member made of light-weight material and is housed within orifice 78, and in the position as seen in FIG. 8, is maintained in fluid tight engagement, that is, disallowing fluid from flowing around it by spring member 84 and by pressurized fluid flow in fluid chamber 87, fluid chamber 87 being bored out of the wall portion of power head 40.

Turning now to the dome portion 62 of valving member 60, dome portion 62 further provides accumulator chamber space 88, which functions to receive fluid flow for imparting movement to disphragm 70, during operation of the valve, the function of which will be described further.

Figure 7:
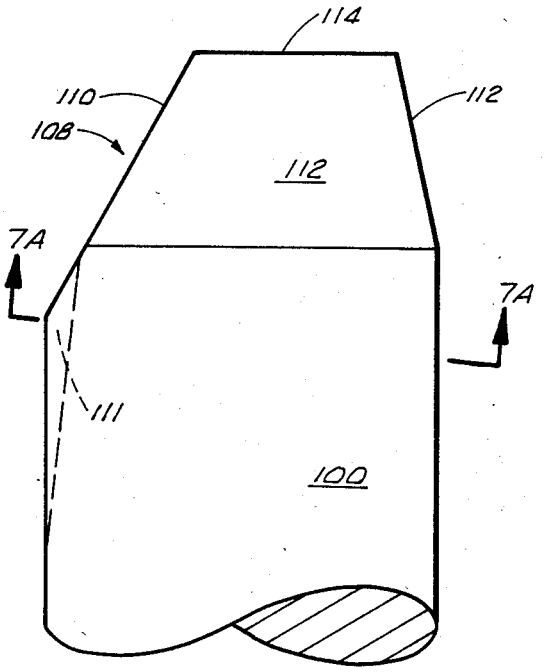
FIG. 7 and 7A are side and front blownup views of the end portion of the needle valve of the timing apparatus of the present invention.
Figure 7A:
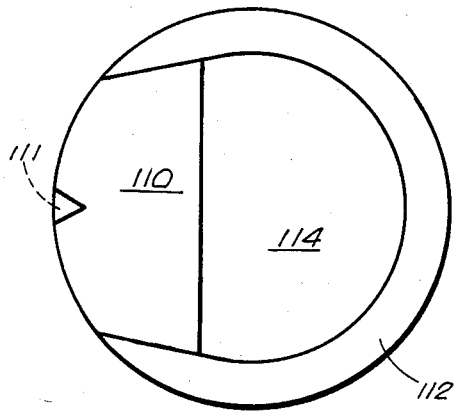
Figure 6:
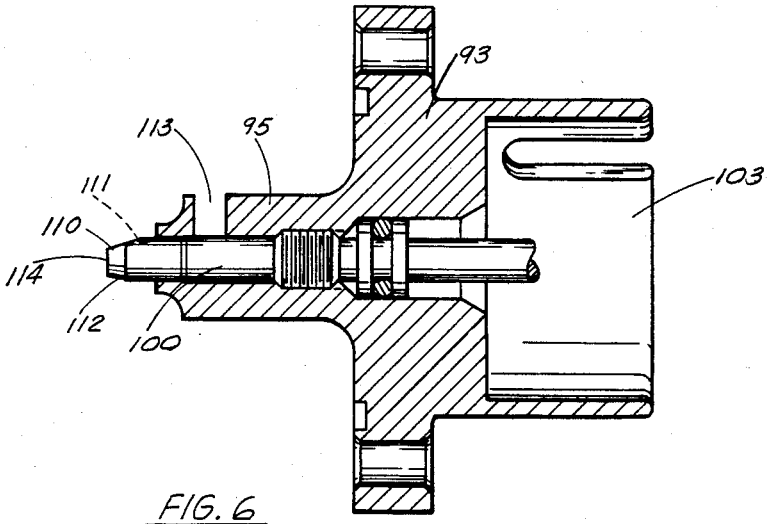
FIG. 6 is a cross-sectional view of the timing means of the apparatus of the present invention.

Turning now to the FIGURES in describing the timing means of apparatus 10, like valving means 44, timing means 46 is likewise mounted to a portion of the face of power head 40, via a pair of mounting screws 90 and 92. As seen in the FIGURES, timing means 46 comprises a body portion 93 which is securely mounted to the face of power head 40, with O-ring 98 providing a fluid tight seal to the outside. Body portion 93 further provides an interior neck housing 95 which, as seen in the FIGURES, is contained within an enlarged bored area 97 in the body of power head 40, with the space between neck portion 95 and the interior wall of the bored area 97 defining a second accumulator space which will be described during the functioning of the valve. As seen in the figures, neck portion 95 is securely mounted onto the interior wall of bore 97 and is in fluid tight engagement via O-ring 98. Extended neck portion 95 provides a continuous internal threaded housing together with main body 93 for needle valve member 100, which comprises an adjustable control knob portion 102, set within a shouldered flange 103 and secured to needle valve member 100, with valve member 100 threadably engaged into valve body 93 and neck portion 95, the end portion 114, of valve member 100 extruding out of neck into fluid passageway 109 within power head 40 which is in fluid communication with cylinder 27 through counter bore 107. As is further seen in FIGS. 7 and 7A of the drawings, stem member 100 further provides at its tip 108, a first angulated face portion 110 and a second continuous face 112 ending at a truncated end portion 114. Face portion 110 further provides a groove 111 cut into the wall of stem member 100 with groove 111 increasing in depth as it approaches the face portion 114. The functioning of the angulated face portions 110 and 112 in combination with the groove 111 will be described more fully in the operation of the valve.

Figure 3:
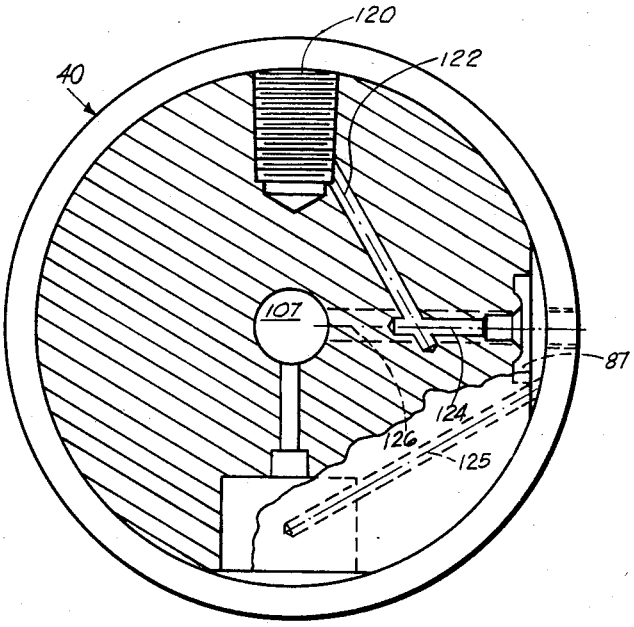
FIG. 3 is a top cross-sectional view of the power head assembly of the apparatus of the present invention illustrating the system of internal fluid passageways therethrough.
Figure 5:
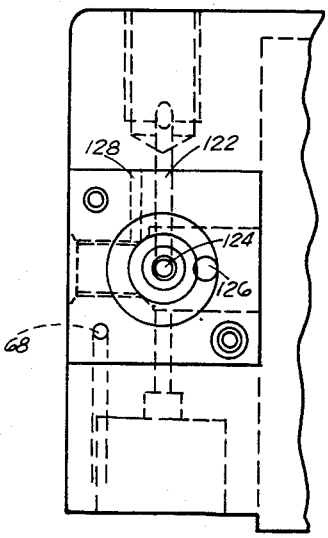
FIG. 5 is a partial side view of the power head assembly of the preferred embodiment illustrating fluid passageways between the valving means and timing means of the present invention.
Figure 4:
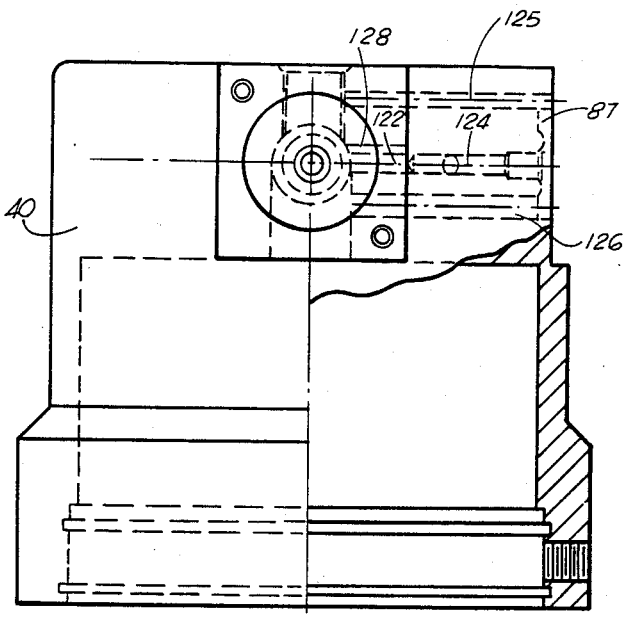
FIG. 4 is a side partial cutaway view of the power head assembly of the apparatus of the present invention illustrating the system of fluid passageways therethrough.

Turning now to the system of interior ports interconnecting and providing fluid communication between the valving means 44, timing means 46 and cylinder 27, attention is now to FIGS. 3 through 5 of the drawings. In FIG. 3, there is provided a top view of power head means 40. As seen in FIG. 3, the power head means 40 provides a first fluid inlet port 120 which is threaded on its interior wall for threadably adapting fitting for the introduction of pressurized fluid into inlet port 120 via line 121 (See FIG. 1). There is bored within thickened body portion 43, extending at an angle from an end portion of inlet port 120, fluid passageway 122 which extends substantially from the end portion of inlet port 120 to a point substantially halfway across the interior body of power head means 40. There is then provided a fluid passageway 124, which is bored substantially at a right angle from inlet port 120, into power head means 40, and intersecting passageway 122, so that together ports 120 fluid passageways 122 and 124 provide a continuous fluid passageway extending from inlet port 120 through the body portion of power head means 40 and out of power head means 40 with the exit point being substantially at a right angle from inlet port 120 at fluid chamber 87. The exit point of fluid passageway 124 is co-axial with the port that houses spring member 84 and is in fluid communication with fluid chamber 87 which lies behind the face of main valving member 72. As seen also in the FIGURES, there is provided a fluid passageway 126 (See FIG. 5) which extends from a point within fluid chamber 87, lies essentially parallel to passageway 124 and is bored directly into central counter bore 107 which houses stroke adjustor screw 52, and allows fluid communication between fluid passageway 126 and cylinder 27. Therefore, with main valve member 72 in the sealed or "pressure" position as seen in FIG. 8, continuous fluid communication is allowed between inlet port 120 through fluid passage 122 and 124, fluid space 87, passageway 126, counter bore 107 and into cylinder space 27.

Turning now to the FIGURES, illustrating the fluid portal system involved with the timing means 46, there is provided, as was discussed earlier, passageway 109, which is in fluid communication with counter bore 107 and cylinder space 27. With the retrieval of needle valve member 100, port 109 is in fluid communication with accumulator space 97 via port 113 in neck portion 95 allowing fluid communication thereto. As seen in the top view of FIG. 3, there is further provided an additional fluid passageway 125 bored in the body of power head means 40, which provides fluid communication between accumulator space 97 and port 68 in main valve body portion 64. Port 68 through main body portion 64 extends to an additional port 132 in the wall of dome member 62, which allows fluid communication between port 68 and accumulator space 88 within dome member 62. Having discussed the structural components of the power head means 14, and the structural components of pump means 12, what follows is a thorough discussion of the dynamics and functioning of the entire apparatus during use of the apparatus.

OPERATION OF APPARATUS

As was discussed earlier in the preferred embodiment, the pneumatically metered pump apparatus 10 provides for the pumping of limited quantities of fluid into a flow line. Essentially, the pump would be alligned vertically in position and mounted as for functioning as such. As was further described earlier, on the pumping means 12 of the apparatus, there would be provided an inlet line threadably connected to suction ball valve 31 for introduction of fluid into pumping chamber 13 and an exit line threadably engaged to discharge check valve 35 for discharge of fluid during the pumping action. Of course, the suctioning into and the discharging out of fluid from the pump would be provided by the upward and downward movement of plunger 21 reciprocating as a result of the reciprocating movement of piston 25 to which plunger 21 is rigidly connected thereto.

The operation of the reciprocal movement of piston 25 depends entirely upon the dynamics of the fluid flow, valving and timing of the fluid flow within power head means against the bias of spring member 26.

In the operation of the power head means 14 of the apparatus 10, air or other suitable gas medium is introduced into inlet port 120 through an inlet line 121 or the like threadably engaged thereunto. Preferably, the air would be introduced at an amount ranging between 10 and 150 pounds per square inch, in order to accomplish the full range of operation of the pump. Upon the introduction of pressurized air into the inlet port 120, the pressurized air would move immediately into interior fluid passageway 122 and onward into second angulated innterior fluid passageway 124. As was described earlier, valving means 44 would be mounted onto the exterior wall of housing 40, with the exit point of fluid passageway 124 being at the central point of spring assisted main valving member 72. From passageway 124, the pressurized air would then flow into fluid chamber 87, which is directly behind main valving member 72 and the flow would impart pressure on the backside of valving member 72 thus placing it in sealing engagement between the wall of bore 78 and thus preventing any fluid flow around the wall of valving member 72 in this point in the operation. (See FIG. 8) The pressurized fluid flow would then be forced to flow into bore 126 which provides fluid communication between the fluid chamber 87 behind valve member 72 and counter bore 107 surrounding stroke adjustor screw 50. Thus pressurized fluid would flow into counter bore 107 which is in fluid communication with cylinder space 27 and thus would flow into cylinder space 27. At this point, the fluid pressure would then pressurize fluid space 27 forcing piston 25 downward in its stroke against the bias of spring 26, until that point that piston 25 has reached its lowest point having abutted against the base of power head 40.

Simultaneous to the pressurization of fluid space 27 from counter bore 107, as was described earlier, there is also in fluid communication with counter bore 107, bore 109 which partially houses the end portion of needle valve member 100. As was described earlier, at that point that needle valve 100 is introduced into passageway, there is provided an exterior elasomeric rigid O-ring member 210 which when the angulated face portions and 110 and 112, and cut groove 111 are introduced beyound the O-ring 210 into bore 109, stem member 100 would create a fluid tight seal between O-ring member 210 and needle valve 100, thus interrupting flow into timing means 46. However, with the threadably retrieval of the end of stem member 107 by rotation of knob 102, at that point, cut groove 111 provides a fluid path between counter bore 107, through passageway 109 to port 113 in neck 95 and into accumulator space 97. And of course, the further retrieval of the stem member 109 out of contact with the O-ring 210, would allow a greater volume of air to flow under pressure through passageway 109 and accumulator space 97. This flow of fluid being adjustable by the rotation of knob 102 provides for a timing mechanism as will be described further.

At this point in the cycle, pressurized air continues to maintain piston 25 in the down position, and simultaneously, with needle valve retrieved to the point where air can flow into accumular space 97, pressurized air fills accumulator space 97 and flows into passageway 125 which is in fluid communication with second accumulator space 88 in the dome portion 74 of valving means 44 through passageway 68 in the main body portion 64 and port 132. Upon the entrance of fluid into accumulator space 88, pressure builds up against the outer face of flexible diaphragm member 70. Due to the relative sizes of the larger flexible diaphragm, the smaller inlet port 124 to main valving unit 72, upon the introduction of a fraction of inlet air pressure on diaphragm 70 as opposed to the amount of pressure on the opposite side against the main valving element, flexible diaphragm 70 is flexed inward against actuator 69, thus moving actuator 69 toward displacing main valving member 72 from its "pressure" or sealed position blocking flow through space 78 and pushing against the bias of spring 84 and inlet air pressure, and unseating valve member 72 from its fluid tight engagement in port 78 thus positioning it into a "exhaust" position, with a snap action (See FIG. 2) and while simultaneously sealing the flow of inlet air through port 124, allowing the exhausting of the pressurized air in cylinder 27 out of cylinder 27 via counter bore 107 back through bore 126 into fluid space 87 around the edge of main valving element 72 to space 78 and out of exhaust port 128 and vented to atmosphere. Likewise, the exhaust air which is still contained in accumulator space 97 and 88, flows back into counter bore 107 and out through bore 126, into space 78 and into exhaust port 128. Likewise, since air has been vented or exhausted from cylinder space 27, and is no longer pressurizing piston 25 in the down position, spring 26 moves piston 25 back in the normally up position, and is in position for another cycle.

Having gone through one complete cycle, and the air vented from both the cylinder space and the accumulator chambers 97 and 88, upon the reduction of air pressure within accumulator space 88 against the face of diaphragm 70, the inlet air in fluid passageway 124 overcomes the reduced vented pressure in accumulator space 88, and shifts the main valving member 72 back into fluid tight engagement against bore 78 with a snap action, (See FIG. 8) and thus being vented, inlet air begins to flow back into cylinder space 27 and the cycle repeats itself. This downward movement of the cylinder forces the plunger member 21 down and thus forces fluid out of the pumping chamber 13, and the upward movement of the piston by spring 26, sucks fluid into the pumping chamber until the cycle is repeated.

It is crucial that several aspects of the operation of the entire dynamic regime be well understood at this point. As was described earlier, the functioning of the valving means 44 depends solely on the presence of opposite pressures working on the face of the main valving element 72 as to the pressure working on the exterior face of flexible diaphragm member 70. Main valving element 72 being light-weight and wafer-shaped as is seen in the drawing, moves a very small amount of space and therefore can be moved very quickly and very easily without any great force being provided in order to effect movement. This is important since this factor allows this pump apparatus to function under a wide rnage of pressures and can be timed at a very slow or a very fast speed because of the relative easy and quick movement of the valving element as it moves from the "pressure" mode, to the "exhaust" mode and back to the "pressure" mode in a relatively brief period of time.

Likewise, the presence of the timing mechanism 46 allowing a very closely metered amount of fluid flow due to the groove and angulated surfaces within the needle valve member, provides for the exact quantity of flow of air through the cycle for effecting a very carefully timed valving function of the apparatus. Although the needle valve position is a crucial point in the timing, it should be made clear that the accumulator space 97 in combination with the accumulator 88, provide for an additional means for regulating or timing the flow of fluid through a cycle.

Timing range of cycles can be varied by adding and removing volume occupying material in accumulator section of timing device. This can be done by removing timer body and placing washers around stem of timer body, or by inserting semiplastic material in cavity of accumulator; or by adding additional chambers to accumulator section; or by using an inflatable or fillable bag, tube, diaphragm or piston cavity; or by extending threaded adjustable volume occupying material into chamber.

Due to the fact that both the timing means 46 and the valving means 44 are secured integral to the power head of the apparatus, in combination with the internal network of fluid passageways providing fluid communication for the necessary elements of the apparatus, provide for a compact metered pumping apparatus which alleviates the necessity of any external tubing which would made it occupy more space and be more cumbersome to construct. Also, in view of the fact that the timing means 46 and valving means 44 can be used on any size power head, interchangeable power heads and interchangeable plungers can produce a range of pumping apparatuses with delivered pressure and volume characterics suitable to the available pneumatic pressure and the discharge pressure and volume required in the process.

Figure 9:
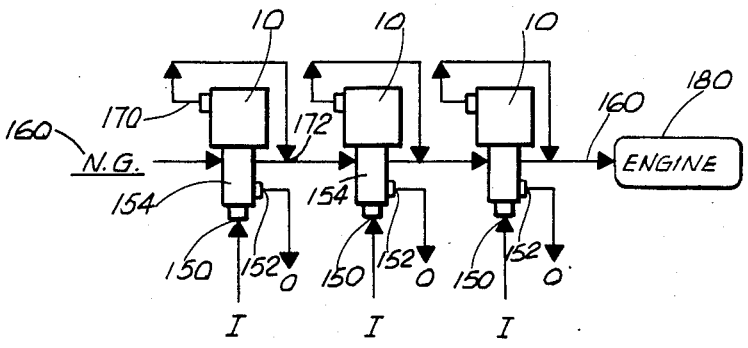
FIG. 9 is a system drawing utilizing a plurality of apparatuses of the present invention in an overall system.

FIG. 9 represents a metered pump apparatus 10 utilized in a system of pumps. As seen in the FIGURE, each pump apparatus 10 would be supplied, as with the single apparatus, with an inlet port 150 for introduction of the fluid or chemical to be pumped and an outlet port 152 for the output of the fluid that has been pumped through the pumping chamber 154. The pump 10 as seen in the FIGURE would be operated by a source of natural gas 160 represented by "N.G." being introduced into the pumping apparatus for flow therethrough to power the apparatus. This flow of natural gas 160 under pressure could be channeled through a successive number of pumps due to the fact that each pump apparatus could require no more than 10 pounds per fluid pressure in order to operate, and therefore, although the reduction of the pressure of natural gas would be lost during successive pumps, if the gas 160 was under sufficient pressure it would be capable of operating a successive number of pumps. Rather than vent to the atmosphere as with the present apparatus, natural gas 160 would then be vented into vent line 170 for return back at point 172 to main line for reuse of the gas, thus not allowing any loss of natural gas to the atmosphere which may be a hazard on a rig or the like. Following the last pump in succession, the natural gas 160 could then be routed to engine 180 for powering of engine 180 as a source of fuel. Therefore, this continuous system would be very efficient in terms of its output and while allowing successive pumps to pump fluid therethrough, thus having a final use for powering engine 180 during its use.

Because many varying and different embodiments may be made within the scope of the invention concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A pneumatic metering pump apparatus, comprising:

a. pump means;

b. power head means further comprising a pneumatically driven piston housed in a cylinder cooperating with said pump means, said piston moveable between first and second positions c. a fluid inlet providing fluid flow to said power head means;

d. valving means on said power head means, including a valving element moveable to a sealing position by said fluid flow and providing fluid communication to said piston when said valving element is in said sealing position, said fluid moving said piston to a second position; and e. means, acted on by said fluid when said piston is in said second position, unseating said valving element, allowing fluid flow to escape said piston cylinder and allowing said piston to return to said first position.

2. The apparatus of claim 1, wherein said pump means further comprises a reciprocating pump member attached to the under side of and moving with said piston, wherein upward and downward movement of said piston imparts upward and downward movement to said pumping member.

3. The apparatus of claim 1, further comprising metering means for metering the rate of fluid flow to said unseating means for unseating said valve member.

4. The apparatus of claim 3, wherein said metering means further comprises a removable pin member for selectively allowing metered amounts of said fluid to flow between said piston and said valve member unseating means.

5. The apparatus of claim 1, wherein said unseating means further comprises a flexible diaphragm member for moving said valving element from a first sealing position to a second non-sealing position in response to fluid pressure on said diaphragm member.

6. A pneumatic metering pump apparatus, comprising:

a. pump means;

b. power head means further comprising a first fluid inlet and a reciprocating piston housed in a cylinder within said power head means and moveable between first and second positions, cooperating with said pumps means;

c. valving means, including a valving element moveable to a first sealing position in response to fluid flow in said first fluid inlet allowing fluid communication between said fluid inlet and said piston when said valving element is in said first sealing position, said fluid flow moving said piston from a first position to a second position;

d. means, acted on by said fluid flow when said piston is in said second position, unseating said valving member, allowing fluid flow to escape said piston cylinder and allowing said piston to return to said first position; and e. metering means, for metering the rate of fluid flow from said piston cylinder to said unseating means for unseating said valving element.

7. The apparatus in claim 6, further comprising means in said power head means for regulating the distance traveled by said piston between said first and said second positions.

8. A pneumatically timed pump apparatus, comprising:

a. a pump having a reciprocating member for pumping fluid through said pump;

b. power head means driving said pump, and further comprising a piston member reciprocating in a cylinder in said power head means, wherein upward and downward movement of said piston drives said reciprocating member;

c. a fluid inlet for allowing pressurized fluid flow into said power head means;

d. valving means, including a valving element moveable to a first sealing position in response to said fluid flow from said fluid inlet for allowing fluid communication between said fluid inlet and said piston when said valving element is in said sealing position, said fluid flow to said piston moving said piston from said first up position to said second down position;

e. metering means likewise secured to the body of said power head means;

f. a plurality of fluid passageways, comprising:

i. a first fluid passageway providing fluid flow between said fluid inlet and said valving means ii. a second fluid passageway providing fluid flow between said valving means and said piston cylinder;

iii. a third fluid passageway providing fluid flow between said metering means and said piston cylinder;

iv. a fourth fluid passageway providing fluid flow between said metering means and said valving means;

said plurality of fluid passageways being bored through the body of said power head means;

v. valving means including, a valving element moveable to a first sealing position in response to said fluid flow from said fluid inlet for allowing fluid communication between said fluid inlet and said piston when said valving element is in said sealing position, said fluid flow to said piston moving said piston from said first up position to said second down position;

vi. metering means, acted on by said fluid flow from said first inlet, for providing metered flow through said fourth passageway into said valving means, said fluid flow imparting pressure on the second side of said valve element causing said valving element to unseat, and allowing fluid flow from said piston cylinder to flow around said valving element and exhaust to atmosphere, thus returning said piston to said first position; and vii. piston stroke adjuster means, threaded into said power head means for limiting the distance of travel of said piston between said up and down positions.

* * * * *

UNITED STATES PATENT AND TRADEMARK OFFICE

CERTIFICATE OF CORRECTION

PATENT NO. : 4,565,504

DATED : January 21, 1986

INVENTOR(S) : Albert L. George and David B. George

It is certified that error appears in the above-identified patent and that said Letters Patent are hereby corrected as shown below:

The middle initial of inventor, Albert A. George should be changed from the letter "A" to the letter --L--.

Signed and Sealed this

*Fifth* Day of *August 1986*

[SEAL]

*Attest:*

DONALD J. QUIGG

*Attesting Officer*

*Commissioner of Patents and Trademarks*